US005201150A

United States Patent [19]

Kuboyama et al.

[11] Patent Number: 5,201,150

[45] Date of Patent: Apr. 13, 1993

[54] WET ABRASIVE BLASTING APPARATUS USING PRESSURIZED SLURRY

[75] Inventors: Matao Kuboyama; Mamoru Iwanabe; Mutsuhiko Suzuki, all of Shizuoka, Japan

[73] Assignee: Fuji Seiki Machine Works, Limited, Shizuoka, Japan

[21] Appl. No.: 728,102

[22] Filed: Jul. 10, 1991

[30] Foreign Application Priority Data

Jul. 24, 1990 [JP] Japan ..... 2-193917

[51] Int. Cl.[5] ..... B24C 7/00; B24C 9/00

[52] U.S. Cl. ..... 51/425; 51/437; 51/439

[58] Field of Search ..... 51/410, 424, 425, 426, 51/436, 437, 439, 263, 319, 320, 321; 366/101

[56] References Cited

U.S. PATENT DOCUMENTS

| | | | |
|---|---|---|---|
| 928,374 | 7/1909 | Ford et al. | 366/101 |
| 1,872,548 | 8/1932 | Zur Löwen | 366/101 |
| 2,797,530 | 7/1957 | Garver | 51/426 |
| 3,343,304 | 9/1967 | Eppler . | |
| 4,253,610 | 3/1981 | Larkin | 51/439 |
| 4,330,968 | 5/1982 | Kobayashi et al. | 51/425 |
| 4,412,402 | 11/1983 | Gallant | 51/439 |
| 4,545,157 | 10/1985 | Saurwein | 51/439 |
| 4,821,467 | 4/1989 | Woodson et al. | 51/436 |
| 4,984,397 | 1/1991 | Van Leeuwen | 51/425 |
| 5,018,317 | 5/1991 | Kiyoshige et al. | 51/439 |
| 5,056,275 | 10/1991 | Wada et al. | 51/437 |
| 5,107,630 | 4/1992 | Lodewijk | 51/410 |

FOREIGN PATENT DOCUMENTS 29-4747 7/1954 Japan .

OTHER PUBLICATIONS

Two-page document "About Our Company" and Feasibility Studies and Sampling, Blast Cleaning and Allied Processes, by H. J. Plaster, (vol. 1), Industrial Newspapers Ltd., 1972, pp. 37, 38, 39 and 41.

*Primary Examiner*—Bruce M. Kisliuk
*Assistant Examiner*—Bryan Reichenbach
*Attorney, Agent, or Firm*—Flynn, Thiel, Boutell & Tanis

[57] ABSTRACT

A blasting apparatus for blasting a pressurized slurry against a workpiece, including an enclosed pressure vessel which is adapted to contain and hold a slurry of abrasive particles and liquid, a piping branch connected to the upper part of the pressure vessel for introducing compressed air in order to pressurize the interior of the vessel, a complementary air circuit which connect the upper part of the pressure vessel with the bottom of the vessel, the circuit having a pressure modulating device which sucks compressed air from the upper part of the vessel and delivers it to the bottom of the vessel, and a blasting gun connected for receiving pressurized slurry from the pressure vessel and discharging it against a workpiece.

5 Claims, 2 Drawing Sheets

WET ABRASIVE BLASTING APPARATUS USING PRESSURIZED SLURRY

FIELD OF THE INVENTION

This invention relates to a wet blasting apparatus in which a pressurized liquid slurry comprising a mixture of a blasting medium of solid particles (hereafter referred to as abrasive particles) and a liquid carrier is blasted from a blasting gun at a high velocity by means of pressurized gas.

In a modification of the invention, a modified blasting gun is used in which a pressurized liquid is used to accelerate the liquid slurry for blasting the work.

BACKGROUND OF THE INVENTION

A variety of blasting methods are known which comprise (1) feeding abrasive particles and liquid carrier into a reservoir and mixing same uniformly therein to form a slurry, (2) sending the slurry to the blasting gun by means of a slurry pump, or ejector means using compressed air, and (3) ejecting the slurry from the blasting gun against the workpiece. These methods include the wet blasting method, the liquid honing method and the water jet method. These blasting methods are widely used for various industrial applications. For example, they are used for descaling of steel fabrications and steel structures, cleaning of various metal surfaces, surface preparation before painting and plating, deburring of machine parts after machining, and so on.

Among the many kinds of known blasting apparatuses, mention is made of the blasting method described in Japanese patent publication No. 29-4747 (1954). In that method (1) compressed air is introduced into the pressure vessel containing the slurry, (2) the slurry contained in said vessel is ejected from the outlet of said vessel, (3) the slurry under pressure is fed to the blasting gun, and (4) the slurry is blasted from the blasting gun so that the abrasive particles and the carrier liquid strike the workpiece. In Japanese patent publication No. 29-4747, the energy of compressed air alone is used to eject and to accelerate the slurry. This is in contrast to other kinds of wet blasting machines, such as the suction-type wet blasting apparatus, or the liquid honing apparatus, in which a slurry pump is used to send the slurry to the blasting gun. Accordingly, the blasting effect was expected to result in lower consumption of compressed air compared with other wet blasting methods.

U.S. Pat. No. 3 343 304 discloses a wet blasting apparatus in which the slurry in the pressure vessel is agitated by means of a rotatable vertical screw.

In the blasting apparatus mentioned in Japanese patent publication No. 29-4747, the blasting operation begins with introduction of compressed air into a pressure vessel after a certain amount of slurry has accumulated in the vessel. Then the pressure of the compressed air on the slurry causes the slurry to be discharged through the outlet of the pressure vessel. Consequently, the duration of the blasting time is limited by the amount of abrasive particles and carrier liquid contained in the vessel. A continuous operation for a long time is difficult. This is one defect of this method.

The duration of the wet blasting operation is limited, and its length is determined, by the volume of the pressure vessel. If the volume of the pressure vessel is increased to provide a longer duration of blasting, another problem arises. It will then be difficult to provide a uniformly mixed slurry. Moreover, as the particle size of the abrasive becomes larger and/or the abrasive particles become heavier, the more difficult it becomes to mix the abrasive particles and the carrier liquid to obtain a uniform homogeneous state and to maintain the resulting slurry in that state. In practice, the range of usable abrasive particle size and the range of duration of blasting time to obtain an even blasting effect are limited in this system.

Because of the above-mentioned limitations or defects of the pressurized wet blasting method using a pressure vessel, the pressurized wet blasting method is used in only a limited range of applications.

Japanese patent publication No. 31-9747 (1956) discloses a method in which abrasive particles and carrier liquid (water) are mixed within a pressure vessel. A perforated steel plate is provided at the bottom of the vessel. Pressurized water is fed in the bottom of the vessel and this water stream flows upwardly to the upper part of the vessel through holes in the perforated steel plate. The water and the abrasive particles are mixed immediately above the perforated steel plate. In this apparatus, the amount of abrasive particles and water in the vessel is limited so that blasting cannot be conducted for a long time, uniformly and continuously.

It is an object of the present invention to provide an apparatus of the pressurized blasting system type in which the consumption of compressed air is minimized, and the blasting operation can be performed continuously and uniformly.

SUMMARY OF THE INVENTION

In the present invention, the measures described in the following paragraphs are preferably employed to solve the above-mentioned problems.

A wet, abrasive, blasting apparatus using a pressurized slurry comprises (a) a completely enclosed pressure vessel which contains and holds a slurry of abrasive particles and carrier liquid, (b) conduit means provided at the upper part of the pressure vessel to introduce compressed air in order to pressurize the contents of the pressure vessel, (c) a complementary (secondary) air circuit is connected to and extends between the upper part of the pressure vessel and the bottom of the pressure vessel and the complementary air circuit has a pressure modulating device which draws air from the upper part of the pressure vessel and delivers it to the bottom of the pressure vessel, and (d) the pressurized slurry in the pressure vessel is discharged through the blasting gun.

A vacuum pump can be employed as the pressure modulating device in the complementary (secondary) air circuit on the pressure vessel. A compressor can also be used.

In the wet blasting apparatus using a pressurized slurry, the invention also provides (a) an enclosed reservoir or storage vessel which has an inlet for compressed air and which is positioned above the pressurizing vessel, (b) a replenishing vessel which supplies liquid and abrasive particles to the reservoir vessel and which is positioned above the reservoir vessel, (c) a first, supply valve in the pipe that connects the replenishing vessel and the reservoir vessel, and (d) a second, reservoir discharge valve in the pipe that connects the reservoir vessel and the pressurizing vessel.

In a modification of the invention, there is provided a wet blasting apparatus in which the slurry contained in the pressurizing vessel is fed to the blasting gun in a uniformly mixed state, in which the blasting gun comprises (a) wall means defining a liquid chamber inside of the gun body and connected for receiving the pressurized liquid in said chamber, (b) a cone-shaped nozzle is connected to the outlet part of the liquid chamber, and the inside of the nozzle forms a tapered initial section which is followed by a discharge nozzle comprising a tapered guide section and a narrow straight discharge nozzle, and (c) a pressurizing section for further pressurizing the delivered slurry is formed by positioning the slurry discharge nozzle in such a way that the end of the slurry nozzle is located at the inside of the tapered section of the cone-shaped nozzle so that the delivered slurry is accelerated by the pressurized liquid delivered from the liquid chamber.

In the operation of the apparatus according to the invention, a part of the compressed air in the pressurizing vessel is flowed through the complementary (secondary) circuit and its pressure is increased by means of a pressure modulating device, such as a vacuum pump. The air that flows through the complementary circuit is discharged upwardly through the pressurizing vessel by flowing through an inlet at the bottom of the pressurizing vessel and the air is dispersed in the slurry in the form of small air bubbles. This spout of small air bubbles flows upwardly through the slurry and mixes it uniformly. The mixed slurry is sent to the blasting gun from the slurry outlet and is blasted onto the workpiece surface with compressed air.

The reservoir vessel and the replenishing vessel are connected in series to the pressurizing vessel. The slurry is supplied from the reservoir vessel to the pressurizing vessel in a short time. A continuous blasting operation can be carried out because the supply of the slurry from the reservoir vessel to the pressurizing vessel requires only a short time.

DETAILED DESCRIPTION

Figure 1:
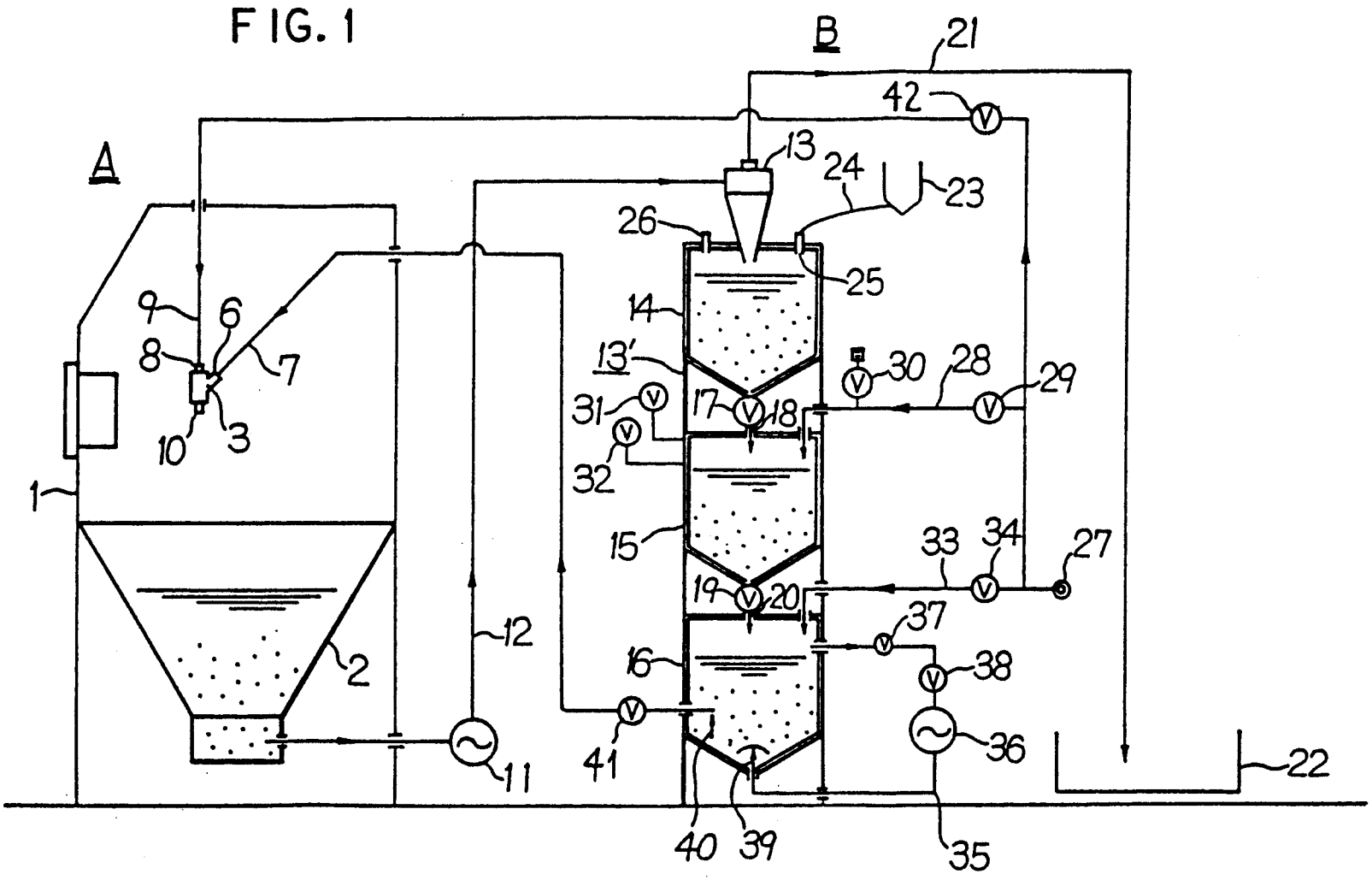
FIG. 1 is a schematic view of the slurry blasting apparatus according to the invention.
Figure 2:
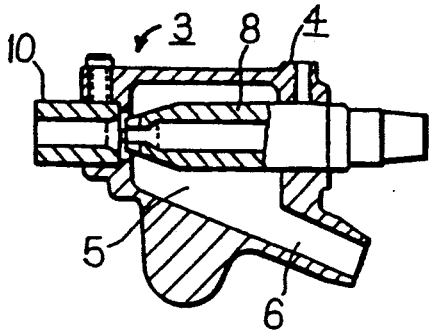
FIG. 2 is a sectional view of the blasting gun or nozzle used in FIG. 1.

The first embodiment of the apparatus according to the present invention is illustrated in FIG. 1 and in FIG. 2. The following description will be made with reference to those two drawings.

In general, the apparatus comprises a blasting device A and slurry circulation system B. In the blasting device A, the blasting gun 3 blasts the workpiece surface with slurry supplied to said blasting gun.

The blasting cabinet or chamber 1 has a collecting hopper or sump 2 in its lower portion in which the used slurry is collected and stored. Referring to FIG. 2, the blasting gun 3 has a body 4 defining an interior slurry chamber 5. The slurry chamber 5 has slurry inlet 6 which is connected to supply conduit 7.

A jet nozzle 8 is positioned in the gun body 4 in such a way that the discharge end of the jet nozzle 8 is located inside of the slurry chamber 5. The jet nozzle 8 is connected to an air supply conduit 9 so that a high velocity jet stream of compressed air is discharged from the jet nozzle 8 across the slurry chamber 5. The slurry is thereby entrained by the compressed air and the slurry is blasted, under the pressure of the compressed air, from a blasting nozzle 10 which is aligned with jet nozzle 8.

The hopper 2 receives the used abrasive particles and carrier liquid after they have been blasted against the surface of the workpiece. The bottom of the hopper 2 is connected with one end of a slurry recycle circuit 12. The used slurry that is accumulated and stored in the hopper 2 is flowed to the hydrocyclone 13 via the slurry recycle circuit 12 by means of the pump 11.

The slurry circulation device B comprises three vessels which are positioned in a vertical array and are connected in series on the support structure 13'. The three vessels are the replenishing vessel 14, the reservoir or storage vessel 15 and the pressurizing vessel 16. Each of the three vessels 14, 15 and 16 is a closed vessel and the vessels are isolated from each other by valves 17 and 19. The lower end of the replenishing vessel 14 and top of the storage vessel 15 are connected by a connecting pipe 18 in which the replenishing vessel discharge valve 17 is located. Also, the lower end of the storage vessel 15 and the top of the pressurizing vessel 16 are connected by a connecting pipe 20 in which the storage vessel discharge valve 19 is located.

The discharge opening at the bottom of the hydrocyclone 13 is connected to and opens into the upper end of the replenishing vessel 14 which is located at the top of the support structure 13'. The reusable fraction of the used abrasive particles is separated, in the hydrocyclone 13, from the detritus and other non-reusable material. The reusable fraction of the abrasive particles is flowed into the replenishing vessel 14. The non-reusable fraction is sent to the drain tank 22 through the drain conduit 21. A hopper 23 containing fresh abrasive particles is connected by a conduit 24 having a valve-controlled discharge port 25 so that make-up abrasive particles can be supplied to the replenishing vessel 14, when needed. A source of fresh carrier liquid, such as water, is connected to the replenishing vessel 14 by the port 26 so that fresh carrier liquid can be supplied, when needed.

The storage vessel 15 is positioned in the middle position on support structure 13', and is connected with the main compressed air supply line 9 by the branch pipe 28. The main air line 9 is connected to a compressed air supply source 27. A main air valve 29 and a pressure relief valve 30 are provided in the branch pipe 28. The storage vessel 15 is pressurized by opening the main air valve 29 and introducing compressed air into the storage vessel 15. The storage vessel 15 has a quick discharge valve 31 for discharging the pressurized air in the vessel 15 to reduce the pressure therein to ambient pressure so that abrasive in the replenishing vessel 14 can move rapidly, by gravity, into the storage vessel 15. Valve 32 is a safety valve for assuring that the vessel 15 does not become over-pressurized.

The pressurizing vessel 16, which is located at the lowest position on support structure 13', is connected with the main air line 9 through a second branch pipe 33. A main air valve 34 is provided on the branch pipe 33. The pressurizing vessel 16 has a complementary (secondary) circuit 35 which is connected to and extends between the top and bottom of the vessel 16. In this complementary (secondary) circuit, a pressure modulating device 36, such as a vacuum pump or diaphragm pump, a flow control valve 37 and a pressure control valve 38, are provided. The complementary circuit 35 has its outlet connected to a port 39 at the bottom of the vessel 16. Pressurized air at the upper end of the vessel 16 is drawn into the circuit 35 by the pressure modulating device 36 and is discharged upwardly into the bottom of the vessel 16. The air fed into the lower end of the vessel 16 has a higher pressure than the pressure of the air at the upper end of the vessel. The slurry in the lower part of the vessel 16 is agitated by the air supplied from the circuit 35.

In a modification of the invention, the complementary (secondary) circuit 35 can be directly connected to the branch pipe 33 instead of to the upper end of the vessel 16.

It will be noted that the pressurizing vessel 16 does not contain a mechanical agitator or impeller for effecting rapid circulation of the slurry therein. Rather, pressurized air is admitted from the open port 39 in the bottom end of the conical bottom section of the pressurizing vessel 16 and rises freely through the vessel in the form of bubbles. The air bubbles are dispersed through the slurry so that the slurry is agitated only by air bubbles. It has been found that this is sufficient to achieve substantial uniformity of the slurry in the pressurizing vessel 16.

A slurry outlet 40 is provided in the lower section of the pressurizing vessel 16 above the port 39. This slurry outlet is connected to the slurry conduit 7 that supplies slurry to the blasting gun 3. A shut-off valve 41 is provided in the slurry conduit 7. A valve 42 is provided in conduit 9 so that supply of air to the blasting gun 3 can be shut-off, when desired.

The apparatus according to the first embodiment of the present invention comprises the above-described parts and the operation is as follows. Fresh abrasive particles are supplied into the replenishing vessel 14 from the abrasive tank 23. Carrier liquid (water) is supplied from intake 26 to vessel 14. By opening the replenishing valve 17, abrasive particles and liquid (water) are transferred into the storage vessel 15. During this transfer step, the quick return valve 31 is opened, thereby reducing the pressure in the storage vessel 15 to ambient pressure. Because of this reduction of the internal pressure in vessel 15, the transfer of abrasive particles and liquid is made easily. When the transfer of abrasive particles and liquid from the replenishing vessel 14 to the storage vessel 15 is finished, the quick return valve 31 and the replenishing valve 17 are shut. While the replenishing valve 17 is shut, the replenishing vessel 14 can be filled with new abrasive and liquid supplied from their respective sources, and/or it can be filled with reusable slurry separated and supplied by the hydrocyclone 13.

The abrasive particles and liquid in the storage vessel 15 can be transferred into the pressurizing tank 16 by opening the valve 19. At that time, the quick return valve 31 also is shut. Alternatively, the abrasive particles and liquid held in the storage vessel 15 can be transferred into the pressurizing vessel 16 by introducing compressed air and increasing the internal pressure at the upper end of the storage vessel 15. For that purpose, the main air valve 29 in the by-pass conduit 28 is opened and the quick return valve 31 is closed.

Immediately after the flow of abrasive particles and liquid into the pressurizing vessel 16 has been completed, valve 19 is shut and air main valve 34 in the by-pass conduit 33 is opened. Compressed air flowing in main air line 9 is introduced into the upper end of the pressurizing vessel 16. The air pressure in the pressurizing vessel 16 is raised to the same pressure as that of the compressed air source. The abrasive particles and liquid are mixed, as described below, and form a slurry. This pressurized slurry flows to the blasting gun 3 and is ejected from it.

Mixing of the abrasive particles and carrier liquid is accomplished in the following way. Compressed air is introduced through line 33 into the pressurizing vessel 16 as described above. A part of the compressed air flows into the complementary (secondary) circuit 35 and then, after passing through volume control valve 37 and pressure control valve 38, its pressure is increased by passing through pressure modulating device 36. Highly pressurized air is ejected from the port 39 at the bottom end of the pressurizing vessel. The air is injected into vessel 16 in the form of many, small, rising bubbles. The abrasive particles, which would otherwise settle to the bottom because of their higher density, are entrained by the upwardly flowing air bubbles so as to cause vigorous agitation of the abrasive particles and the liquid. The abrasive particles and the liquid are mixed and form a uniform slurry. The solid abrasive particles do not clog at the port 39.

The flow of slurry from the pressurizing vessel 16 to the blasting gun 3 does not cease until the abrasive particles are exhausted. When the amount of abrasive and carrier liquid remaining in the vessel 16 reaches a minimum value, the internal pressure of the pressurizing vessel 16 and that of the storage vessel 15 are made equal, and then, the valve 19 is opened. A predetermined amount of abrasive particles and liquid flow into the pressurizing vessel 16.

By repeating this process, a slurry of abrasive particles and liquid can be sent to the blasting gun 3 and discharged from said gun without any interruption. A continuous blasting operation can be effected.

The slurry which is mixed in the pressurizing vessel 16 by injection of highly pressurized air from the pressure modulating device 36 can be blasted from the blasting gun 3 as is. In this case, the blasted slurry which had been pressurized in the vessel 16 has sufficient energy. Accordingly, a powerful blasting operation can be obtained. But it is preferred that the slurry introduced into the slurry inlet 6 of the blasting gun 3 be further accelerated by the compressed air that is supplied by the jet nozzle 8, and then be blasted from the nozzle of the gun.

The second embodiment of this invention shall be explained by reference to FIG. 3. The apparatus of the second embodiment is featured by using a pressurized liquid as the accelerating medium for the slurry. Blasting device A and slurry circulation system B can be the same as those described in the first embodiment. Accordingly a description of those two devices is omitted.

Figure 3:
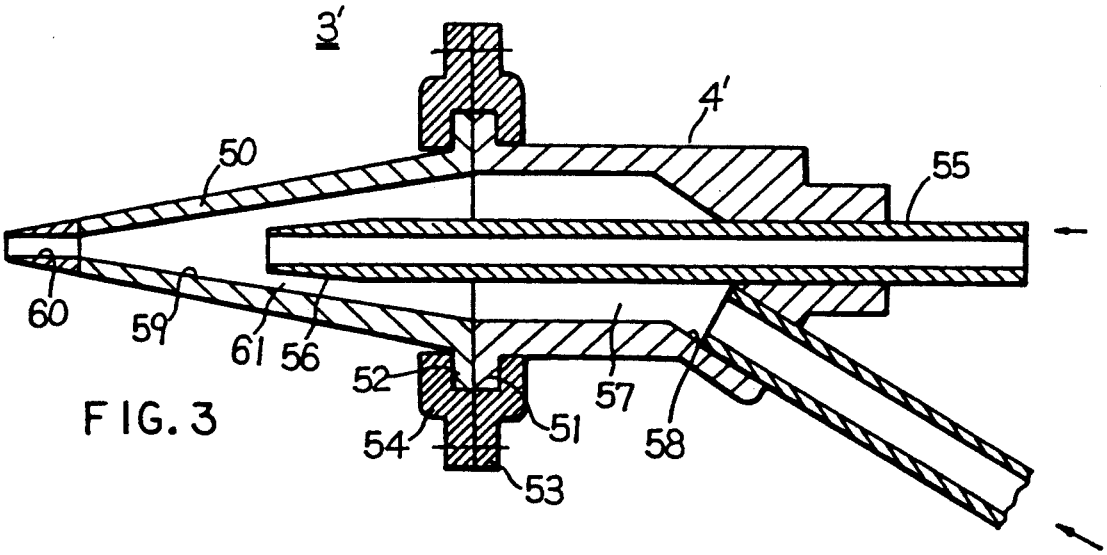
FIG. 3 is a sectional view of a modified blasting gun or nozzle for use in the invention.

The blasting gun 3 in FIG. 3 has a tapered nozzle 50 mounted on one end of the gun body 4'. The said one end of the gun body 4' and the wide end of the nozzle 50 have mating flanges 51 and 52. The facing surfaces of the two flanges 51 and 52 contact each other closely. The external diameters of the two flanges 51 and 52 are equal. Two connecting rings 53 and 54, the radially inner edge portions of which cover the edges of the two flanges 51 and 52, clamp both flanges and they are fastened to each other by fastening bolts (not shown). The slurry nozzle 55 penetrates through the other end of the gun body 4' and is fixed at a location in which the end of the slurry nozzle 55 is positioned substantially at the center of the chamber 61 defined by the internal wall of the nozzle 50. The head of the slurry nozzle 55 forms a tapered nose 56. The gun body 4 has an internal chamber 57 for receiving pressurized liquid. Liquid (usually water) pressurized to 30 kg/cm$^2$ or higher, is introduced into the liquid chamber 57 through liquid inlet 58 on the gun body.

The tapered nozzle 50 has a tapered internal surface 59. This internal surface 59 forms a chamber 61 providing a pathway which extends to the tapered nose of the nozzle 50. A cylindrical discharge nozzle section 60 is provided at the end of the tapered internal surface 59 of the nozzle. Thus, pressurized slurry from the slurry nozzle 55 and highly pressurized liquid from the liquid inlet 58 are mixed as they pass through the tapered nozzle 50. The pressurized slurry is additionally pressurized by the pressurized liquid and is blasted from the cylindrical nozzle section 60.

The tapered nozzle 50 may comprise two parts, and it is not necessarily of one-piece construction. In such case, the nose 56 of the slurry nozzle 58 can protrude a little into one of the two nozzle sections, which nozzle section communicates directly with the liquid chamber 57.

As described in the first embodiment, the slurry pressurized inside the pressurizing vessel 16 of the slurry circulation device B is introduced into the slurry nozzle 55 through the slurry conduit 7, and is blasted from said nozzle. Simultaneously, liquid pressurized to a pressure equal to or higher than 30 kg/cm$^2$ is introduced into the liquid chamber 57. The pressure of the pressurized liquid gets higher as it flows through the passageway 61 and then it is sent to the tapered nozzle 50. At the inner surface 59 of said tapered nozzle 50, the liquid and slurry discharged from the slurry nozzle 55 are mixed with each other, and the slurry is further accelerated at the tapered section 59 of the nozzle. This accelerated slurry is ejected from the gun 3' against the workpiece surface.

The slurry made in the pressurizing vessel 16 is agitated by compressed air, the pressure of which is modulated by the pressure modulating device 36 in the complementary air circuit so that the slurry can maintain a uniformly mixed condition all the time.

The interior of the pressurizing vessel 16 is pressurized by compressed air and the compressed air in the pressurizing vessel 16 is sent, together with the slurry, to the blasting gun. The air consumption is reduced to 50 percent of that in the case of the conventional method because the air in the pressurizing vessel is sent together with the slurry to the blasting gun. The slurry is under pressure in the pressurizing vessel 16 and use of such pressurized slurry increases the blasting power compared to that of the conventional methods. The working efficiency is increased.

In the blasting gun described in the second embodiment, the velocity of the slurry and the pressurized liquid is increased in the blasting nozzle so that a very efficient operation can be performed.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. Blasting apparatus for blasting a pressurized slurry against a workpiece, comprising a completely enclosed pressure vessel which is adapted to contain and hold a slurry of abrasive particles and liquid, a piping branch connected to the upper end of said pressure vessel for introducing compressed air in order to pressurize the interior of said pressure vessel, a secondary air circuit which connects the upper end of said pressure vessel with the bottom of said pressure vessel, said circuit having a pressure modulating device which sucks compressed air from the upper end of said pressure vessel and delivers it to the bottom of said pressure vessel, and a blasting gun connected by a slurry delivery conduit for receiving pressurized slurry from said pressure vessel and discharging it against a workpiece.

2. The blasting apparatus as defined in claim 1 further comprising an enclosed storage vessel having an inlet for compressed air, said storage vessel being located above said pressure vessel, a replenishing vessel adapted for supplying liquid and abrasive particles to said storage vessel and which is located above said storage vessel, a first conduit connecting said replenishing vessel and said storage vessel, a first valve in said first conduit, a second conduit connecting said storage vessel and said pressure vessel, and a second valve in said second conduit.

3. Slurry blasting apparatus as defined by claim 1 in which the pressure modulating device in said secondary circuit is a vacuum pump.

4. In a wet abrasive blasting apparatus using a slurry comprised of abrasive and a liquid carrier therefor, comprising a pressure vessel for containing the slurry, means for applying compressed air to the upper end of said pressure vessel above the surface of the slurry therein, a blasting gun connected by a slurry delivery conduit to said vessel and adapted for receiving the pressurized slurry and blasting the slurry against a workpiece, a secondary compressed air circuit connected to and extending between the upper and lower ends of said pressure vessel, said secondary compressed air circuit including a pressure modulating device which is effective to withdraw air from the upper end of said pressure vessel and above the surface of the slurry therein and deliver the air to the lower end of said pressure vessel so that the slurry in said pressure vessel is continuously agitated by air flowing upwardly therethrough.

5. A wet abrasive blasting apparatus as claimed in claim 4 in which said pressure vessel is free of a mechanical agitator so that the contents of said pressure vessel are mixed solely by the air from said secondary circuit, said pressure vessel having an inverted conical section at its lower end, a port located at the bottom of said conical section and connected to said secondary circuit so that compressed air from said secondary circuit is admitted through said port into the bottom of said pressure vessel and rises freely through said vessel.

* * * * *